US008186811B2

(12) United States Patent
Kim et al.

(10) Patent No.: US 8,186,811 B2
(45) Date of Patent: May 29, 2012

(54) INKJET PRINTING APPARATUS AND METHOD OF DRIVING INKJET PRINTING APPARATUS

(75) Inventors: Joonghyuk Kim, Seoul (KR); Jae-woo Chung, Yongin-si (KR); Young-ki Hong, Anyang-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 207 days.

(21) Appl. No.: 12/662,732

(22) Filed: Apr. 30, 2010

(65) Prior Publication Data

US 2011/0134195 A1 Jun. 9, 2011

(30) Foreign Application Priority Data

Dec. 9, 2009 (KR) ..... 10-2009-0121945

(51) Int. Cl.
*B41J 2/045* (2006.01)

(52) U.S. Cl. ..... 347/71

(58) Field of Classification Search ..... 347/52, 347/55, 71, 73–76, 96, 125
See application file for complete search history.

(56) References Cited

U.S. PATENT DOCUMENTS

| | | | | |
|---|---|---|---|---|
| 2004/0141034 | A1 | 7/2004 | Usui et al. | |
| 2006/0268033 | A1 | 11/2006 | Satake | |
| 2008/0129769 | A1* | 6/2008 | Kim | 347/10 |

FOREIGN PATENT DOCUMENTS

| | | |
|---|---|---|
| EP | 0 145 130 | 8/1984 |
| JP | 05-338150 | 12/1993 |
| JP | 09-327908 | 12/1997 |
| JP | 2000-168069 | 6/2000 |
| JP | 2006-150983 | 6/2006 |
| KR | 10-0602933 | 7/2006 |

* cited by examiner

*Primary Examiner* — Matthew Luu
*Assistant Examiner* — Lisa M Solomon
(74) *Attorney, Agent, or Firm* — Harness, Dickey & Pierce, P.L.C.

(57) ABSTRACT

An inkjet printing apparatus according to example embodiments may include a flow channel plate including an ink inlet for introducing ink, a pressure chamber containing the introduced ink, and a nozzle connected to the pressure chamber and configured to eject ink. A piezoelectric voltage applier may apply a piezoelectric driving voltage to the piezoelectric actuator in such a way that the volume of the pressure chamber is reduced so as to eject an ink droplet. An electrohydrodynamic voltage applier may apply a first electrohydrodynamic driving voltage and a second electrohydrodynamic driving voltage to the electrohydrodynamic actuator. The first electrohydrodynamic driving voltage may generate a jet from the ink droplet such that the jet is ejected towards a printing medium, and the second electrohydrodynamic driving voltage (which has an opposite polarity to that of the first electrohydrodynamic driving voltage) may restore the ink droplet to the nozzle.

14 Claims, 6 Drawing Sheets

INKJET PRINTING APPARATUS AND METHOD OF DRIVING INKJET PRINTING APPARATUS

CROSS-REFERENCE TO RELATED APPLICATION

This application claims priority under 35 U.S.C. §119 to Korean Patent Application No. 10-2009-0121945, filed on Dec. 9, 2009 with the Korean Intellectual Property Office, the disclosure of which is incorporated herein in its entirety by reference.

BACKGROUND

1. Field

The present disclosure relates to inkjet printing apparatuses driven using piezoelectric and electrohydrodynamic techniques, and methods of driving the inkjet printing apparatuses.

2. Description of the Related Art

An inkjet printing apparatus is a device for printing a predetermined color image by ejecting minute droplets of ink on desired areas of a printing medium example (e.g., printing sheet) by using an inkjet head. Inkjet printing apparatuses have been widely used in various applications, including flat displays (e.g., liquid crystal displays (LCDs)), organic light emitting devices (OLEDs), flexible displays (e.g., E-paper), printed electronics (e.g., metal wirings), and organic thin film transistors (OTFTs). When inkjet printing apparatuses are used in various display fields or printed electronics fields, high-resolution and superprecision printing are of relatively high importance.

Inkjet printing apparatuses may use various ink ejecting methods, including a piezoelectric method and an electrohydrodynamic method. In the piezoelectric method, ink droplets are ejected by deformation of a piezoelectric material. In the electrohydrodynamic method, ink droplets are ejected by an electrohydrodynamic force. Because an inkjet printing apparatus using the piezoelectric method may eject ink droplets in a drop on demand (DOD) manner, it is relatively easy to control the printing operation. In addition, because an inkjet printing apparatus using the electrohydrodynamic method forms minute droplets of ink with relative ease, an inkjet printing apparatus using the electrohydrodynamic method may facilitate precision printing.

SUMMARY

Example embodiments relate to inkjet printing apparatuses configured to eject a minute amount of ink droplets by using piezoelectric and electrohydrodynamic techniques, and methods of driving the inkjet printing apparatuses.

An inkjet printing apparatus according to example embodiments may include a flow channel plate including an ink inlet configured to receive ink, a pressure chamber configured to contain the ink, and a nozzle connected to the pressure chamber and configured to eject the ink; a piezoelectric actuator configured to exert a piezoelectric driving force to the ink by modifying a volume of the pressure chamber; an electrohydrodynamic actuator configured to exert an electrohydrodynamic driving force to the ink; a piezoelectric voltage applier configured to apply a piezoelectric driving voltage to the piezoelectric actuator such that the volume of the pressure chamber is reduced so as to eject an ink droplet; and an electrohydrodynamic voltage applier configured to apply a first electrohydrodynamic driving voltage and a second electrohydrodynamic driving voltage to the electrohydrodynamic actuator, the first electrohydrodynamic driving voltage being applied so as to generate a jet from the ink droplet such that the jet is ejected towards a printing medium, the second electrohydrodynamic driving voltage having a polarity opposite to that of the first electrohydrodynamic driving voltage, the second electrohydrodynamic driving voltage being applied so as to restore the ink droplet to the nozzle.

The electrohydrodynamic voltage applier may be configured to apply the second electrohydrodynamic driving voltage after the jet has detached from the ink droplet. The electrohydrodynamic voltage applier may also be configured to apply the second electrohydrodynamic driving voltage after the jet has landed on the printing medium. The electrohydrodynamic voltage applier may be configured to apply the first electrohydrodynamic driving voltage in synchronization with the piezoelectric driving voltage. Alternatively, the electrohydrodynamic voltage applier may be configured to apply the first electrohydrodynamic driving voltage prior to the piezoelectric driving voltage.

A method of driving an inkjet printing apparatus according to example embodiments may include applying a piezoelectric driving voltage to a piezoelectric actuator to eject an ink droplet through a nozzle and applying a first electrohydrodynamic driving voltage to an electrohydrodynamic actuator to generate a jet; removing the piezoelectric driving voltage; and applying a second electrohydrodynamic driving voltage to the electrohydrodynamic actuator, the second electrohydrodynamic driving voltage having a polarity opposite to that of the first electrohydrodynamic driving voltage, the second electrohydrodynamic driving voltage applied so as to restore the ink droplet to the nozzle.

The second electrohydrodynamic driving voltage may be applied after the jet has detached from the ink droplet. The second electrohydrodynamic driving voltage may also be applied after the jet has landed on a printing medium. The first electrohydrodynamic driving voltage may be applied in synchronization with the piezoelectric driving voltage. Alternatively, the first electrohydrodynamic driving voltage may be applied prior to the piezoelectric driving voltage.

The piezoelectric actuator may exert a piezoelectric driving force in response to the piezoelectric driving voltage. The electrohydrodynamic actuator may exert an electrohydrodynamic driving force in response to the first and second electrohydrodynamic driving voltages. The piezoelectric driving voltage may be applied with a piezoelectric voltage applier. The first and second electrohydrodynamic driving voltages may be applied with an electrohydrodynamic voltage applier.

BRIEF DESCRIPTION OF THE DRAWINGS

The above and/or other aspects of example embodiments may become more apparent and readily appreciated when the following description is taken in conjunction with the accompanying drawings of which.

DETAILED DESCRIPTION

Figure 1:
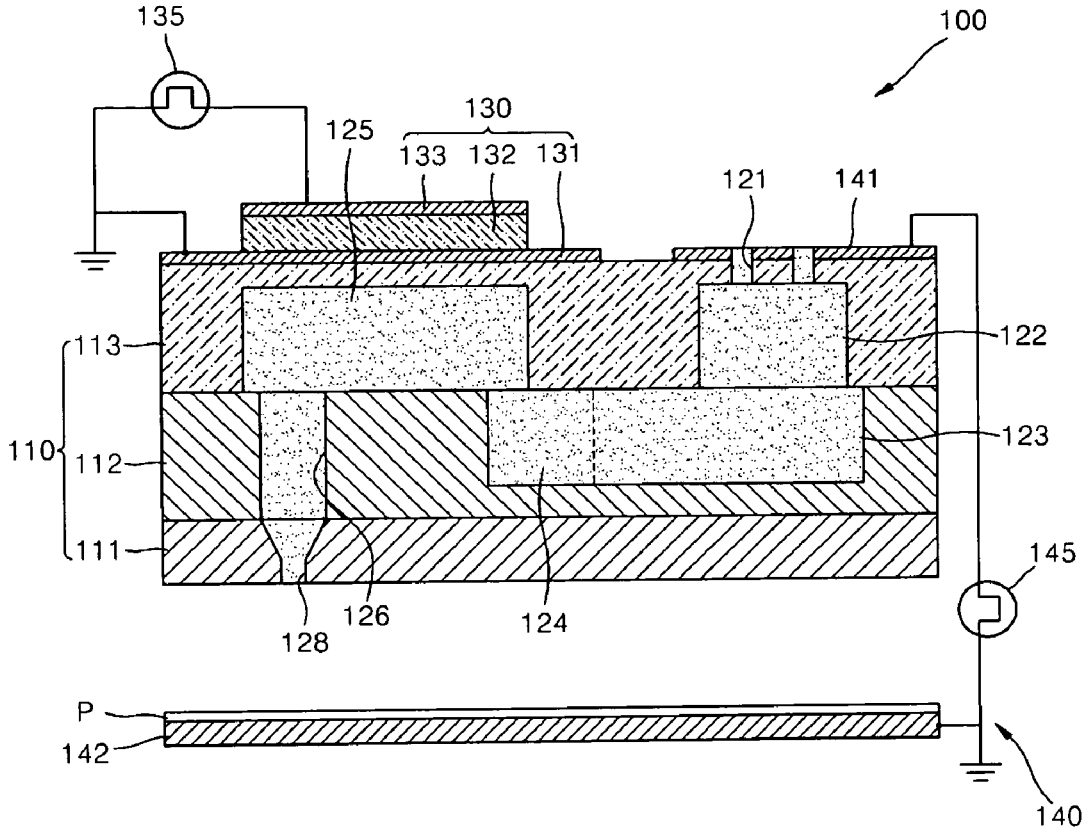
FIG. 1 is a cross-sectional view of an inkjet printing apparatus according to example embodiments.

It will be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, e.g., "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms, "comprises," "comprising," "includes," and/or "including," if used herein, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a cross-sectional view of an inkjet printing apparatus according to example embodiments. Referring to FIG. 1, the inkjet printing apparatus may include an inkjet head 100 for ejecting ink droplets by using a piezoelectric method. For example, the inkjet head 100 may be fixed and may eject ink droplets on a moving printing medium 'P'. Alternatively, the printing medium 'P' may be fixed, and the inkjet head 100 may move while ejecting ink droplets on the printing medium 'P'. In yet another non-limiting embodiment, both the inkjet head 100 and the printing medium 'P' may move relative to each other. For instance, the printing medium 'P' may move in a designated direction, and the inkjet head 100 may eject ink droplets while moving in a direction perpendicular to the moving direction of the printing medium 'P'. To achieve this, although not shown, the inkjet printing apparatus may further include a moving device for moving at least one of the inkjet head 100 and the printing medium 'P' at a predetermined speed.

The inkjet head 100 may include a flow channel plate 110 and a piezoelectric actuator 130. The flow channel plate 110 may include an ink flow channel, and the piezoelectric actuator 130 may provide a driving force for ejecting ink droplets. The ink flow channel may be formed in the flow channel plate 110. The ink flow channel may include an ink inlet 121 to which ink is introduced, a plurality of pressure chambers 125 containing the ink, and a plurality of nozzles 128 for ejecting ink droplets. The ink inlet 121 may be formed in an upper portion of the flow channel plate 110 and may be connected to an ink tank (not shown). Ink provided from the ink tank may be introduced into the flow channel plate 110 through the ink inlet 121. The pressure chambers 125 may be formed in the flow channel plate 110 and may store the ink introduced through the ink inlet 121. Manifolds 122 and 123 and a restrictor 124 may be formed in the flow channel plate 110 in order to connect the ink inlet 121 and the pressure chambers 125 to each other. The nozzles 128 may be connected to the respective pressure chambers 125 so that one to one correspondence with the respective pressure chambers 125 may occur. Ink filled in the pressure chambers 125 may be ejected through the nozzles 128 in a droplet shape. The nozzles 128 may be formed in a lower portion of the flow channel plate 110 and may be arranged in at least one row. A plurality of dampers 126 for respectively connecting the pressure chambers 125 and the nozzles 128 to each other may be formed in the flow channel plate 110.

The flow channel plate 110 may be a substrate formed of a material having suitable micromachining properties, e.g., a silicon substrate. For example, the flow channel plate 110 may be configured by sequentially bonding three substrates, which may include a first substrate 111, a second substrate 112 and a third substrate 113, by using a silicon direct bonding (SDB) method. The ink inlet 121 may be formed through the uppermost substrate, which may be the third substrate 113. The pressure chambers 125 may be formed in the third substrate 113 so as to have a height measured from a lower surface thereof. The nozzles 128 may be formed through the lowermost substrate, which may be the first substrate 111. The manifolds 122 and 123 may be formed in the third substrate 113 and the second substrate 112 disposed between the first substrate 111 and the third substrate 113, respectively. The dampers 126 may be formed through the second substrate 112.

Although the flow channel plate 110 is shown in FIG. 1 as including the first, second, and third substrates 111, 112, and 113, respectively, it should be understood that example embodiments are not limited thereto. For instance, the flow channel plate 110 may include one substrate, two substrates, or four substrates or more, and ink flow channels formed in the flow channel plate 110 may be arranged in a number of various ways.

The piezoelectric actuator 130 may provide a piezoelectric driving force for ejecting ink. For instance, the piezoelectric actuator 130 may provide a pressure change to the pressure chambers 125 and may be formed on a portion of an upper surface of the flow channel plate 110 corresponding to the pressure chambers 125. The piezoelectric actuator 130 may include a lower electrode 131, a piezoelectric film 132, and an upper electrode 133 which may be sequentially formed on the flow channel plate 110. The lower electrode 131 may function as a common electrode, and the upper electrode 133 may function as a driving electrode for applying a voltage to the piezoelectric film 132. A piezoelectric voltage applier 135 may apply a piezoelectric driving voltage between the lower electrode 131 and the upper electrode 133. The piezoelectric film 132 may be deformed by the piezoelectric driving voltage applied by the piezoelectric voltage applier 135 to deform the third substrate 113 constituting an upper wall of the pressure chamber 125. The piezoelectric film 132 may be formed of a predetermined piezoelectric material, e.g., a lead zirconate titanate (PZT) ceramic material.

An electrohydrodynamic actuator 140 may provide an electrohydrodynamic driving force to the ink contained in the nozzles 128 and may include a first electrohydrodynamic electrode 141 and a second electrohydrodynamic electrode 142 which may face each other. An electrohydrodynamic voltage applier 145 may apply an electrohydrodynamic voltage between the first electrohydrodynamic electrode 141 and the second electrohydrodynamic electrode 142. For example, the first electrohydrodynamic electrode 141 may be disposed on the flow channel plate 110. The first electrohydrodynamic electrode 141 may be formed on an upper surface of the flow channel plate 110, which may be an upper surface of the third substrate 113. The first electrohydrodynamic electrode 141 may also be formed on a portion of the flow channel plate 110 in which the ink inlet 121 is formed so as to be spaced apart from the lower electrode 131 of the piezoelectric actuator 130. The second electrohydrodynamic electrode 142 may be disposed so as to be spaced apart from a lower surface of the flow channel plate 110. The printing medium 'P' on which ink droplets ejected from the nozzles 128 of the flow channel plate 110 are printed may be positioned on the second electrohydrodynamic electrode 142.

Figure 2:
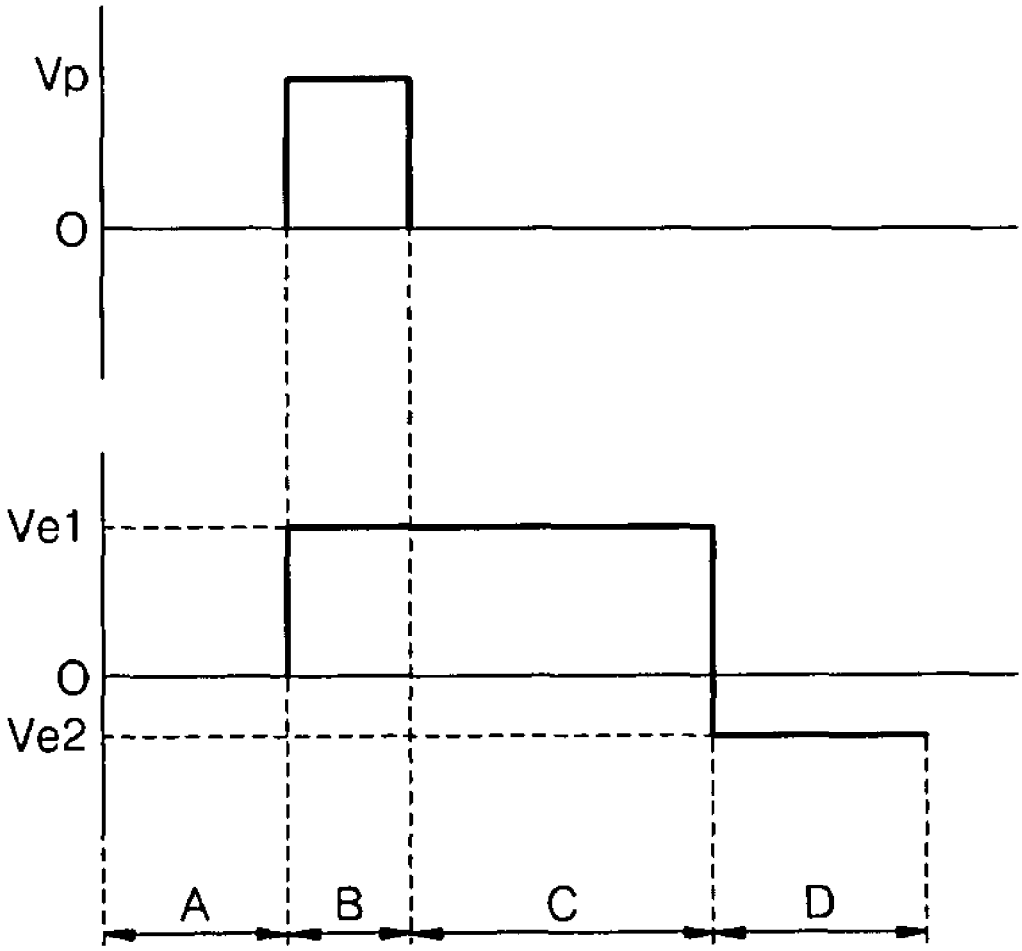
FIG. 2 is a graph showing the timing of an electrohydrodynamic driving voltage and a piezoelectric driving voltage in a method of driving the inkjet printing apparatus of FIG. 1 according to example embodiments.

FIG. 2 is a graph showing the timing of an electrohydrodynamic driving voltage and a piezoelectric driving voltage in a method of driving the inkjet printing apparatus of FIG. 1 according to example embodiments. FIGS. 3 through 8 are diagrams for explaining a process of ejecting ink performed by the electrohydrodynamic driving voltage and the piezoelectric driving voltage of FIG. 2 according to example embodiments.

Figure 3:
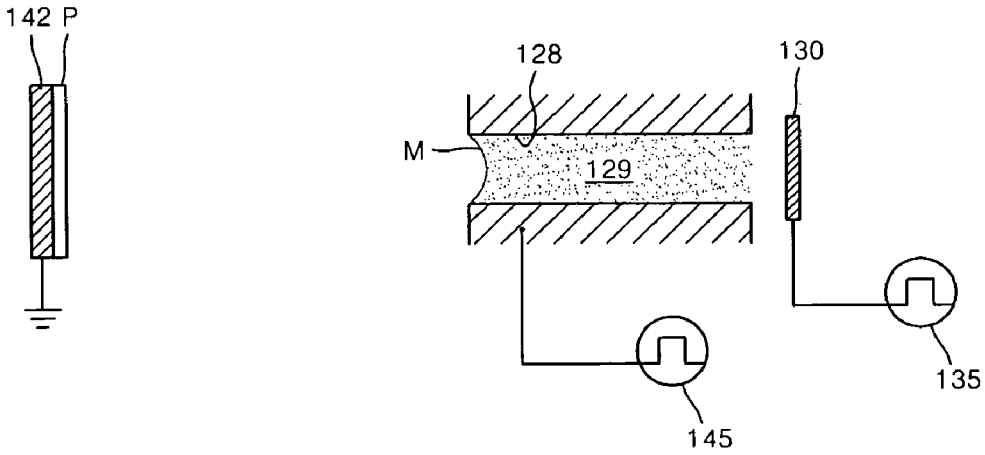
FIG. 3 is a diagram illustrating a state of an end of a nozzle when a piezoelectric driving voltage and a first electrohydrodynamic driving voltage have not yet been applied according to example embodiments.

In a time period A of FIG. 2, a driving voltage has not been applied to the piezoelectric actuator 130 and the electrohydrodynamic actuator 140. In this case, as shown in FIG. 3, a concave or flat meniscus 'M' may be formed at an end of the nozzle 128 by the surface tension of the ink 129.

Figure 4:
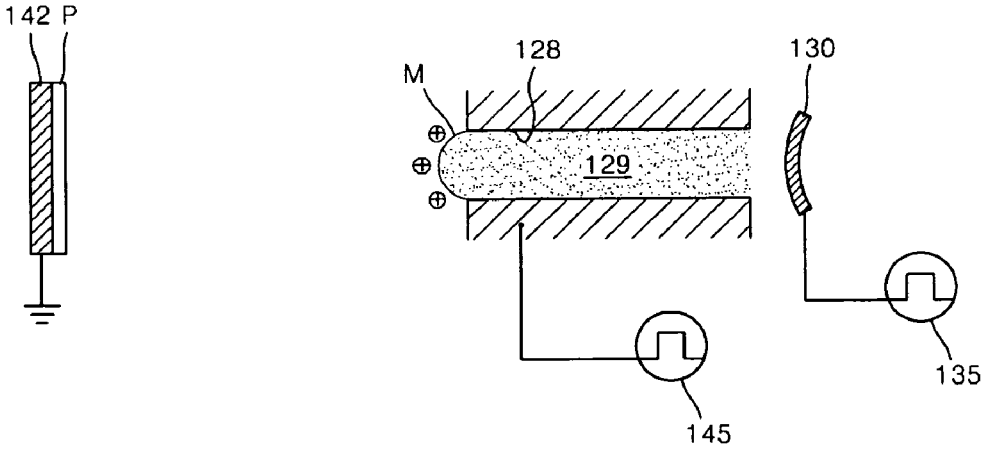
FIG. 4 is a diagram illustrating a state of an end of a nozzle when a piezoelectric driving voltage and a first electrohydrodynamic driving voltage are applied according to example embodiments.

In a time period B of FIG. 2, a piezoelectric driving voltage $V_p$ and a first electrohydrodynamic driving voltage $V_{e1}$ may be applied to the piezoelectric actuator 130 and the electrohydrodynamic actuator 140, respectively. The piezoelectric driving voltage $V_p$ may be, for example, in the range of about 50 to about 90 V. The first electrohydrodynamic driving voltage $V_{e1}$ may be, for example, in the range of about 2 to about 5 kV. When the piezoelectric driving voltage Vp is applied to the piezoelectric actuator 130, the piezoelectric actuator 130 may be deformed in such a way that a volume of the pressure chamber 125 is reduced. As a result of this deformation, a pressure acts on the ink 129 so as to drive it towards the outside of the nozzle 128. As shown in FIG. 4, the ink 129 has moved towards the outside of the nozzle 128 such that the meniscus 'M' is deformed so as to be convex. When the convex meniscus 'M' is formed, an electric field formed by the first electrohydrodynamic driving voltage $V_{e1}$ may become concentrated, and positive charges contained in the ink 129 may move towards the second electrohydrodynamic electrode 142 so as to accumulate at an end of the nozzle 128. As the ink 129 moves further to the outside of the nozzle 128 in response to the pressure provided by the piezoelectric actuator 130, a radius of curvature of the meniscus 'M' may be further reduced.

Figure 5:
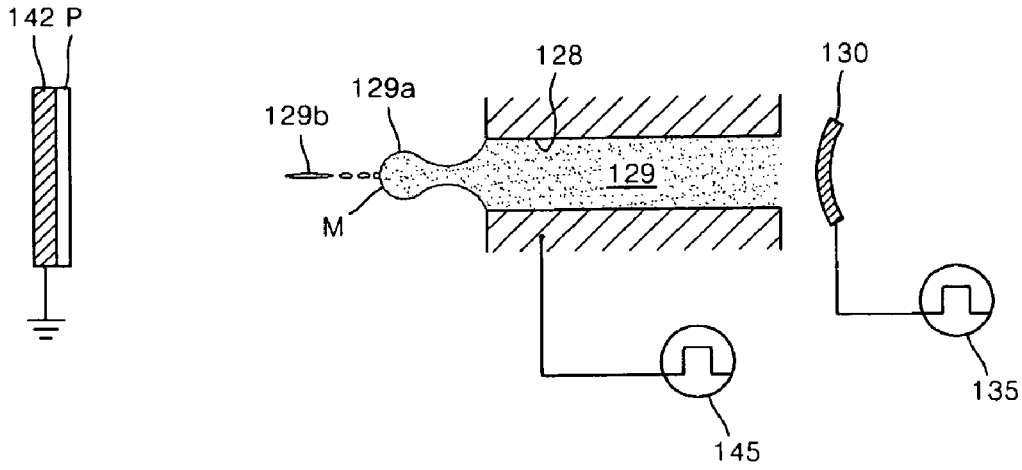
FIG. 5 is a diagram illustrating a state where a jet is formed at an end of a nozzle according to example embodiments.

An electrohydrodynamic force is proportional to a charge amount and an intensity of an electric field. Also, the charge amount is proportional to the intensity of the electric field. Thus, the electrohydrodynamic force is proportional to a square of the intensity of the electric field. The electrohydrodynamic force is also inversely proportional to the radius of curvature of the meniscus 'M'. Accordingly, the electrohydrodynamic force applied to the ink 129 in a convexed meniscus M of the nozzle 128 is inversely proportional to a square of a radius of curvature of the convexed meniscus M. Thus, the electrohydrodynamic force acting on the ink 128 at the end of the meniscus 'M' is increased when the radius of curvature of the meniscus 'M' is reduced. As a result, as shown in FIG. 5, in a fore-end of an ink droplet 129*a*, a force for moving the ink droplet 129*a* towards the second electrohydrodynamic electrode 142 becomes greater than a force for maintaining the ink droplet 129*a* (e.g., surface tension), and thus a minute amount of ink may be ejected from the ink droplet 129*a* towards the second electrohydrodynamic electrode 142 in the form of a jet 129*b*.

Figure 6:
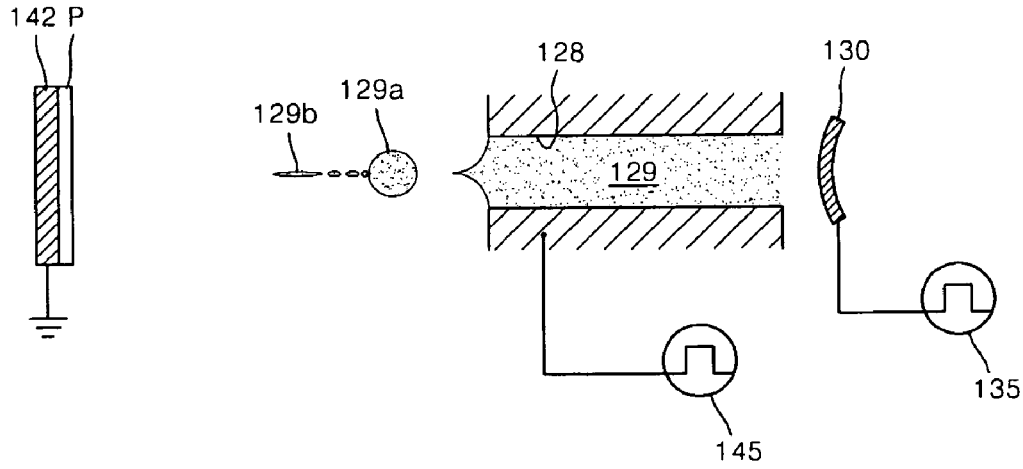
FIG. 6 is a diagram illustrating a state where an attached jet and ink droplet are ejected according to example embodiments.

As shown in FIG. 6, the ink droplet 129*a* may also leave the nozzle 128 as a result of the pressure provided by the piezoelectric actuator 130 and may be ejected towards the printing medium 'P'. The jet 129*b* may have not yet detached from the ink droplet 129*a* during ejection.

Figure 7:
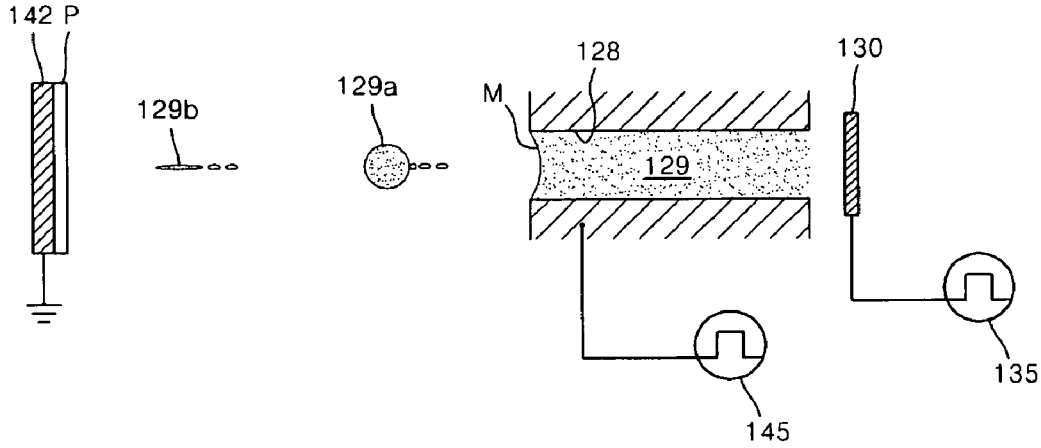
FIG. 7 is a diagram illustrating a state where a jet detached from an ink droplet is ejected according to example embodiments.

In a time period C of FIG. 2, the piezoelectric driving voltage $V_p$ applied to the piezoelectric actuator 130 may be removed. In this case, the piezoelectric actuator 130 may be restored back to its original position, and the meniscus 'M' of the ink 129 at the end of the nozzle 128 may be restored back to a concave shape. In the time period C, the first electrohydrodynamic driving voltage $V_{e1}$ may be maintained and continuously applied. Because a volume of the jet 129*b* is smaller than that of the ink droplet 129*a* and more of the charges accumulate in the jet 129*b*, the jet 129*b* may be accelerated by an electrohydrodynamic force. Thus, the jet 129*b* may be ejected at a higher speed than that of the ink droplet 129*a*. In addition, as shown in FIG. 7, the jet 129*b* may become detached from the ink droplet 129*a* as it travels towards the second electrohydrodynamic electrode 142 at a relatively high speed.

Figure 8:
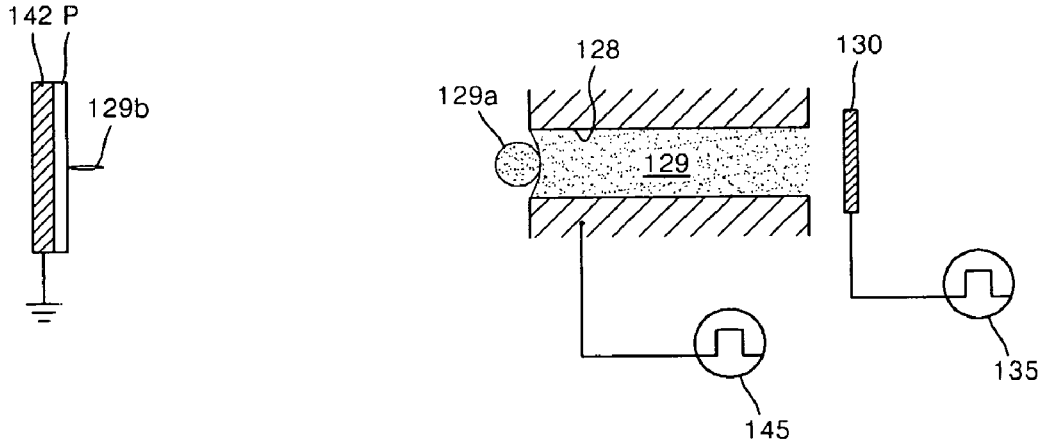
FIG. 8 is a diagram illustrating a state where an ink droplet is restored to a nozzle by a second electrohydrodynamic driving voltage according to example embodiments.

In a time period D of FIG. 2, a second electrohydrodynamic driving voltage $V_{e2}$ may be applied to the electrohydrodynamic actuator 140. The second electrohydrodynamic driving voltage $V_{e2}$ has an opposite polarity to that of the first electrohydrodynamic driving voltage $V_{e1}$. For example, the second electrohydrodynamic driving voltage $V_{e2}$ may be a negative voltage of about −1 kV. A direction of an electric field resulting from the second electrohydrodynamic driving voltage $V_{e2}$ may be opposite to that of an electric field resulting from the first electrohydrodynamic driving voltage $V_{e1}$. Thus, an electric force may act on the jet 129*b* and the ink droplet 129*a* in a direction towards the nozzle 128. As shown in FIG. 8, because the jet 129*b* has already been accelerated by the first electrohydrodynamic driving voltage $V_{e1}$ and is closer to the printing medium 'P' than to the ink droplet 129*a*, the jet 129*b* continues towards the printing medium 'P' so as to land on the printing medium 'P'. In contrast, the relatively large and slower ink droplet 129*a* is drawn back towards the nozzle 128 as a result of the electric force provided by the second electrohydrodynamic driving voltage $V_{e2}$.

As described above, while the ink droplet 129*a* is being ejected by applying the piezoelectric driving voltage $V_p$ to the piezoelectric actuator 130, the first electrohydrodynamic driving voltage $V_{e1}$ may be applied to generate the jet 129*b*. Based on a speed difference between the jet 129*b* and the ink droplet 129*b*, an electric force may be provided by the second electrohydrodynamic driving voltage $V_{e2}$ (which has an opposite polarity to the first electrohydrodynamic driving voltage $V_{e1}$) such that only the jet 129*b* lands on the printing medium 'P' while the ink droplet 129*a* is drawn back to the nozzle 128. Thus, a minute pattern may be formed on the printing medium 'P' by reducing an amount of ink landing on the printing medium V'. In addition, minute ink having a relatively small size compared to the nozzle 128 may be ejected without reducing a diameter of the nozzle 128. For instance, minute ink droplets may be ejected at a level of several pico liters even though the nozzle 128 may have a relatively large diameter (e.g., a diameter in the range of several μm to several tens of μm). Furthermore, because the nozzle 128 may have a relatively large diameter and minute ink droplets are being ejected, clogging of the nozzle 128 is greatly reduced, thereby increasing the reliability of the printing apparatus.

The second electrohydrodynamic driving voltage $V_{e2}$ may be applied at a point in time after the jet 129*b* has detached from the ink droplet 129*a*. Because the jet 129*b* moves at a higher speed than that of the ink droplet 129*a*, the second electrohydrodynamic driving voltage $V_{e2}$ may be applied so as to not deter the jet 129*b* from landing on the printing medium 'P'.

In addition, the second electrohydrodynamic driving voltage $V_{e2}$ may be applied at a point in time after the jet 129*b* has landed on the printing medium P. Because the jet 129*b* moves at a higher speed than that of the ink droplet 129*a*, the ink droplet 129*a* may still be relatively close to the nozzle 128 when the jet 129*b* lands on the printing medium P. Thus, the ink droplet 129*a* may be restored back to the nozzle 128 as a result of the second electrohydrodynamic driving voltage $V_{e2}$.

As described above, the second electrohydrodynamic driving voltage $V_{e2}$ may be applied to an appropriate point in time after the jet 129*b* has detached from the ink droplet 129*a*. After the jet 129*b* has completely landed on the printing medium 'P', an increased degree of freedom for selecting an amount of the second electrohydrodynamic driving voltage $V_{e2}$ for restoring the ink droplet 129*a* may be obtained.

An amount of the piezoelectric driving voltage $V_p$ may be selected so as to satisfy conditions for ejecting the jet 129*b* by forming the ink droplet 129*a* to reduce the radius of curvature of the meniscus 'M'. The piezoelectric driving voltage $V_p$ may not be particularly limited as long as the piezoelectric driving voltage $V_p$ functions as a trigger for ejecting the jet 129*b*. Thus, by reducing the piezoelectric driving voltage $V_p$ as much as possible so as to satisfy the above conditions, an amount of the second electrohydrodynamic driving voltage $V_{e2}$ necessary for restoring the ink droplet 129*a* may be reduced.

Figure 9:
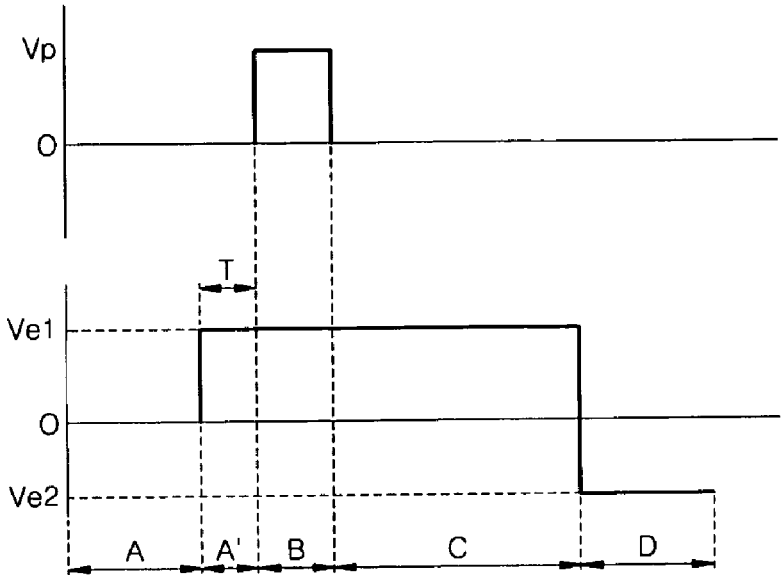
FIG. 9 is a graph showing the timing of an electrohydrodynamic driving voltage and a piezoelectric driving voltage in another method of driving the inkjet printing apparatus of FIG. 1 according to example embodiments.
Figure 10:
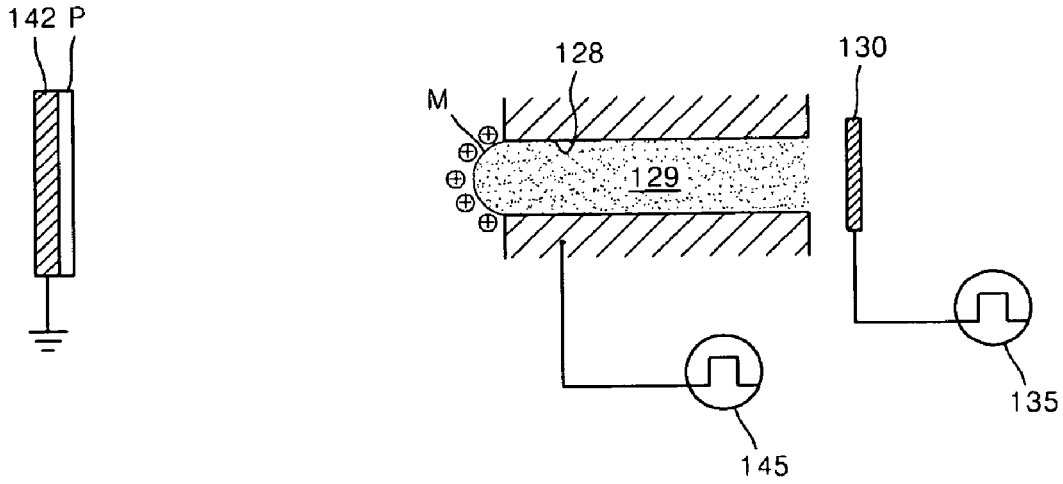
FIG. 10 is a diagram illustrating a state of an end of a nozzle when a first electrohydrodynamic driving voltage is applied prior to a piezoelectric driving voltage according to example embodiments.

The piezoelectric driving voltage $V_p$ and the first electrohydrodynamic driving voltage $V_{e1}$ may be synchronized with each other, but example embodiments are not limited thereto. As shown in FIG. 9, in a time period A', the first electrohydrodynamic driving voltage $V_{e1}$ may be applied prior to applying the piezoelectric driving voltage $V_p$. A period of time 'T' elapses after the first electrohydrodynamic driving voltage $V_{e1}$ is applied before the piezoelectric driving voltage $V_p$ may be applied. Thus, as shown in FIG. 10, an electrohydrodynamic force may act on the ink 129 in the nozzle 128 as a result of the first electrohydrodynamic driving voltage $V_{e1}$, and the meniscus 'M' of the ink 129 may be deformed so as to be slightly convex. When the meniscus 'M' is deformed to be convex, an electric field becomes concentrated on the meniscus 'M', and positive charges contained in the ink 129 may move towards the second electrohydrodynamic electrode 142 so as to accumulate at an end of the nozzle 128. The following time periods B, C, and D may be as described above. By applying the first electrohydrodynamic driving voltage $V_{e1}$ prior to applying the piezoelectric driving voltage $V_p$, the jet 129*b* may be further formed, an amount of the piezoelectric driving voltage $V_p$ may be reduced, and an amount of the second electrohydrodynamic driving voltage $V_{e2}$ for restoring the ink droplet 129*a* may be reduced.

While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

What is claimed is:

1. An inkjet printing apparatus comprising:

a flow channel plate including an ink inlet configured to receive ink, a pressure chamber configured to contain the ink, and a nozzle connected to the pressure chamber and configured to eject the ink;

a piezoelectric actuator configured to exert a piezoelectric driving force to the ink by modifying a volume of the pressure chamber;

an electrohydrodynamic actuator configured to exert an electrohydrodynamic driving force to the ink;

a piezoelectric voltage applier configured to apply a piezoelectric driving voltage to the piezoelectric actuator such that the volume of the pressure chamber is reduced so as to eject an ink droplet; and an electrohydrodynamic voltage applier configured to apply a first electrohydrodynamic driving voltage and a second electrohydrodynamic driving voltage to the electrohydrodynamic actuator, the first electrohydrodynamic driving voltage being applied so as to generate a jet from the ink droplet such that the jet is ejected towards a printing medium, the second electrohydrodynamic driving voltage having a polarity opposite to that of the first electrohydrodynamic driving voltage, the second electrohydrodynamic driving voltage being applied so as to restore the ink droplet to the nozzle.

2. The inkjet printing apparatus of claim 1, wherein the electrohydrodynamic voltage applier is configured to apply the second electrohydrodynamic driving voltage after the jet has detached from the ink droplet.

3. The inkjet printing apparatus of claim 1, wherein the electrohydrodynamic voltage applier is configured to apply the second electrohydrodynamic driving voltage after the jet has landed on the printing medium.

4. The inkjet printing apparatus of claim 1, wherein the electrohydrodynamic voltage applier is configured to apply the first electrohydrodynamic driving voltage in synchronization with the piezoelectric driving voltage.

5. The inkjet printing apparatus of claim 1, wherein the electrohydrodynamic voltage applier is configured to apply the first electrohydrodynamic driving voltage prior to the piezoelectric driving voltage.

6. A method of driving an inkjet printing apparatus, comprising:

applying a piezoelectric driving voltage to a piezoelectric actuator to eject an ink droplet through a nozzle and applying a first electrohydrodynamic driving voltage to an electrohydrodynamic actuator to generate a jet;

removing the piezoelectric driving voltage; and applying a second electrohydrodynamic driving voltage to the electrohydrodynamic actuator, the second electrohydrodynamic driving voltage having a polarity opposite to that of the first electrohydrodynamic driving voltage, the second electrohydrodynamic driving voltage applied so as to restore the ink droplet to the nozzle.

7. The method of claim 6, wherein the second electrohydrodynamic driving voltage is applied after the jet has detached from the ink droplet.

8. The method of claim 6, wherein the second electrohydrodynamic driving voltage is applied after the jet has landed on a printing medium.

9. The method of claim 6, wherein the first electrohydrodynamic driving voltage is applied in synchronization with the piezoelectric driving voltage.

10. The method of claim 6, wherein the first electrohydrodynamic driving voltage is applied prior to the piezoelectric driving voltage.

11. The method of claim 6, wherein the piezoelectric actuator exerts a piezoelectric driving force in response to the piezoelectric driving voltage.

12. The method of claim 6, wherein the electrohydrodynamic actuator exerts an electrohydrodynamic driving force in response to the first and second electrohydrodynamic driving voltages.

13. The method of claim 6, wherein the piezoelectric driving voltage is applied with a piezoelectric voltage applier.

14. The method of claim 6, wherein the first and second electrohydrodynamic driving voltages are applied with an electrohydrodynamic voltage applier.

* * * * *